US006198366B1

(12) United States Patent
Dahl et al.

(10) Patent No.: US 6,198,366 B1
(45) Date of Patent: Mar. 6, 2001

(54) TUNING DEVICE AND METHOD OF MANUFACTURING THE SAME

(75) Inventors: Torbjörn Dahl, Sandared; Sten-Åke Nilsson, Fristad, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/246,685

(22) Filed: Feb. 9, 1999

(30) Foreign Application Priority Data

Feb. 9, 1998 (SE) ..... 9800378

(51) Int. Cl.[7] ..... H01P 7/00; H01P 1/20; H01P 7/06

(52) U.S. Cl. ..... 333/235; 333/203; 333/207; 333/232

(58) Field of Search ..... 333/202, 203, 333/207, 232, 235

(56) References Cited

U.S. PATENT DOCUMENTS 4,035,749 7/1977 Slocum et al. .
4,794,354 12/1988 Dinsmore et al. .
4,963,841 * 10/1990 Sparagna ..... 333/235
5,712,606 * 1/1998 Sarkka ..... 333/235
5,825,267 * 10/1998 Smith ..... 333/202
5,847,627 * 12/1998 Radzikowski et al. ..... 333/202

FOREIGN PATENT DOCUMENTS 40 26 062 2/1992 (DE) .
5-152845 6/1993 (JP) .

* cited by examiner

*Primary Examiner*—Robert Pascal
*Assistant Examiner*—Patricia T. Nguyen
(74) *Attorney, Agent, or Firm*—Burns, Doane, Swecker & Mathis, L.L.P.

(57) ABSTRACT

A trimming arrangement in a device for tuning and/or adaptation of electromagnetic waves includes at least one trimming screw galvanically connected to the device and at least one bushing portion arranged for inserting and securing the screw. The bushing portion includes a substantially pervious opening arranged in a part of the device, a section arranged in the opening reception of the screw and a constriction arranged in an axial direction of the opening, which constriction is provided to firmly but detachably secure the screw.

25 Claims, 3 Drawing Sheets

TUNING DEVICE AND METHOD OF MANUFACTURING THE SAME

This application claims priority under 35 U.S.C. §§119 and/or 365 to 9800378-3 filed in Sweden on Feb. 9, 1998; the entire content of which is hereby incorporated by reference.

TECHNICAL FIELD

The present invention refers to a trimming arrangement in a device for tuning and/or adaptation of electromagnetic waves, including a trimming screw galvanically connected to the device and a bushing portion for inserting and securing the screw.

The invention also refers to a method of producing the trimming arrangement and a device including the same.

BACKGROUND

In microwave equipments, such as filters, oscillating circuits, resonators etc., trimming screws are used to tune and adapt the frequency. Generally, the trimming screw is secured with a locknut after the tuning. In an ordinary screw joint, e.g. in a filter or the like, occurs a certain amount of play between the thread and the screw, which effects the trimming of the filter. Moreover, when the locknut is tightened to secure the screw joint, the tuning is effected.

Since the frequency tuning is significant for the function of a microwave filter or the like, an incorrect tuning, even with very small variation, may consequently effect function of it and other devices enclosed in a microwave transmitter/transponder/receiver. It is therefore important that the trimming screw can be screwed so that an exact desired tuned position can be obtained and that the screw maintains its position and it is not influenced by the changes in the temperature, vibrations and so on. Moreover, parts of many devices are made of material, such as plastic, which makes the production of threads of small dimensions difficult in the material.

JP 5-152845 describes an oscillating circuit cover of which is manufactured of plated plastic material. A trimming screw corresponding to the position of a dielectric resonator is arranged in the ceiling of the cover by screwing it in a tubular metallic nut. The nut is cast in one piece with the cover. The screw is not secured.

Securing the trimming screw or device is known, for example through DE-A1-40 26 062, in which a trimming bolt is connected to a screw which dislocates it. The screw is fixed by a clamp nut pressing a conical flexible insert against the screw.

In U.S. Pat. No. 4,794,354 a locking insert of rubber is used to maintain a screw connected to a resonance element by means of a bar.

SUMMARY

The main object of the present invention is to provide a device for insertion of a trimming screw in a microwave device without above-mentioned drawbacks. Another object of the present invention is to provide a trimming arrangement, for example in devices intended for microwave applications, such as filters, resonating circuits and so on, which allows adaption of frequency and prevents unwanted variations of the adapted frequency in a cost-effective and reliable way.

These objects are obtained by means of the trimming arrangement, described in the preamble, featured by the bushing portion including an essentially pervious opening arranged in a part of the device, a part arranged in the opening for receiving the screw and a constriction arranged in the axial direction of the opening and formed relative the screw to firmly but detachably secure the screw.

The galvanic connection is achieved by providing the bushing portion and surface of the device with a conducting coating. In an advantageous embodiment, said part consists of a bushing. Moreover, said part can exhibit essentially conical threads. Preferably, the constriction is arranged with phased edges for cooperation with threads of the screw. To obtain an electric connection with good density, the constriction is particularly arranged with the conducting coating, which can consist of nickel, copper, gold, silver or the like.

The invention also refers to a device for adaptation and/or tuning of electromagnetic frequencies. The device mainly includes a compartment provided with a number of resonators, a cover which closes the compartment, one or more trimming devices arranged in corresponding openings and connection conductors. Each trimming device includes a conducting trimming screw, a threaded part for reception of the screw and a locking member arranged in the axial direction of the opening formed as a collar with an inner diameter, substantially corresponding to the inner diameter of the screw. Advantageously, the device is made of an insulating material coated with a conducting coating. Said insulating material is preferably a polymer material with a metallized surface which allows a cold flow in the material.

Preferably, the thread part is a bushing inserted in the opening. However, the threaded part consists of essentially conical threads arranged in the opening. In a preferred embodiment the collar is a part of the opening. The device can be a filter, resonator or the like and the electromagnetic waves are microwaves.

The method for producing the bushing portion in the device includes the steps of producing at least a part of the device, for example through moulding, casting or milling, arranging at least an essentially pervious opening having varying diameter in a part of the device when producing it, inserting a bushing into the opening, and providing the bushing and the detail with a conducting surface. The bushing is inserted into the opening preferably through force fit, hot pressing or the like.

BRIEF DESCRIPTION OF THE DRAWINGS

The invention will be described under reference to attached drawings, which show embodiments, in which.

DETAILED DESCRIPTION

In that following a microwave filter including one or more trimming parts, according to invention will be described. However, the invention is not limited to microwave filters, which is given here only as an example. Advantageously, the invention can be utilized in other parts of a transponder/receiver/transmitter for electromagnetic waves where a tuning of frequencies is required. The function of the microwave filter or similar device is assumed to be well-known to a skilled person and will not be described in more detail here.

Figure 1:
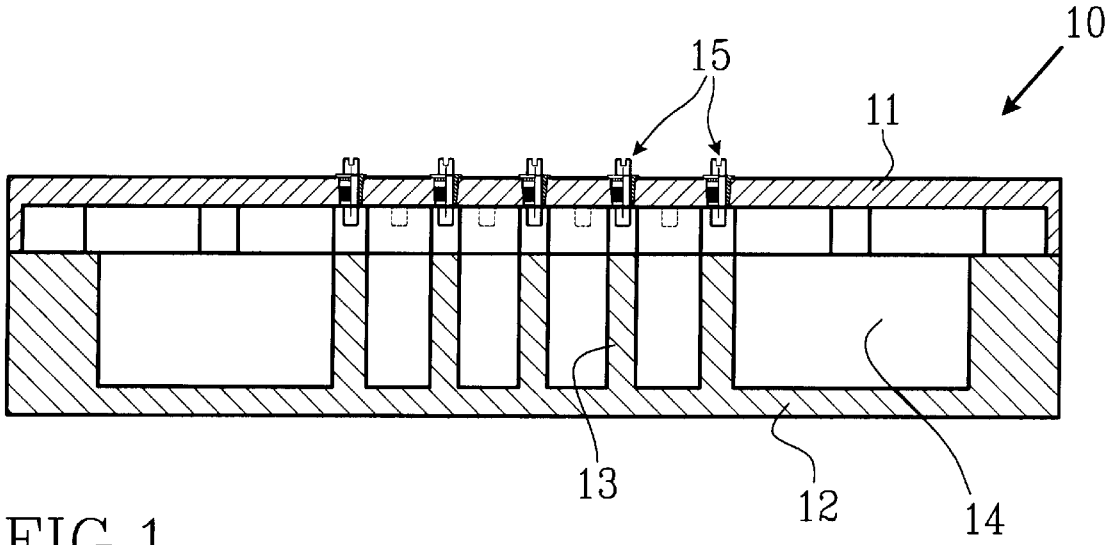
FIG. 1 shows schematically a cross-section through a filter provided with a trimming part, according to the invention.

The filter 10 in FIG. 1 comprises a compartment 12 provided with a cover 11. The compartment 12 essentially includes a member 13 and cavities 14 as well as conductors (not shown) for coupling frequency. Members 13 basically function as resonators. In the cover 11 a number of trimming devices 15 are provided, one of which is shown enlarged in FIG. 2. The trimming devices 15 cooperate with resonators 13 when tuning and adapting the frequency. In an advantageous embodiment, the compartment and the cover are mainly made of plastic, reinforced plastic, glass, other polymeric material or the like. To arrange these as a filter, the parts are provided with a conducting coating, for example through metallisation or plating.

The trimming device 15 mainly consists of a screw 16 and a bushing 17 introduced in an opening 18 in the cover 11. The screw 16, which in this case is a throttle stop screw, is made of a conducting material. The bushing 17 is arranged with internal threads corresponding to threads of the screw and made of a conducting material preferably copper, but other metals for example stainless steel or the like may also be used. The bushing 17 is on its external surface provided with a frictional area 21 for better attachment in the opening 18.

The bushing 17 is primarily used because certain plastic or other materials, from which the parts (cover and/or the compartment) are made of, can be hard workable, specially when producing very small threads in the openings arranged in the parts and specially when the thickness of the parts is very small, generally smaller than 5 mm.

Figure 3:
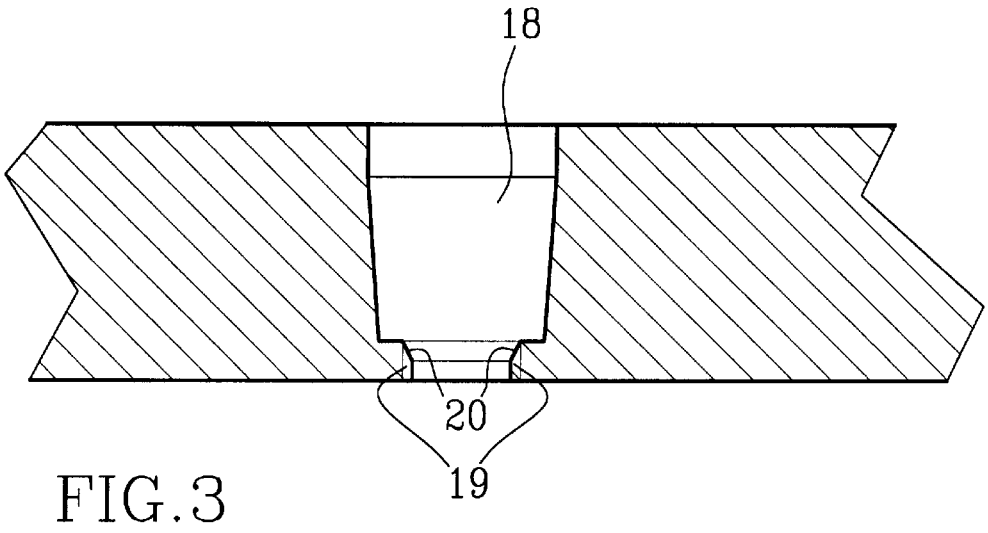
FIG. 3 is the part shown in FIG. 2 with the screw removed.

The opening has an essentially conical shape, which is shown in detail in FIG. 3, which essentially may be formed cylindrically and its design mainly depends on the bushing or the portion provided with threads which should be inserted in there. The lower part of the opening has a smaller inside diameter, corresponding to the inside diameter of the trimming screws and forms a collar 19 with beveled upper edge 20 (possibly, also the lower edge). The bevel 20 essentially corresponds to the inclination of the flank of the screw threads and is intended to cooperate with threads of the screw. In the filter, the best function is obtained when the inner surface of the cover is plane, i.e. the collar 19 is arranged in the base of the opening 18, however one or more collars can be arranged anywhere in the axial direction of the opening before or after the bushing.

Figure 2:
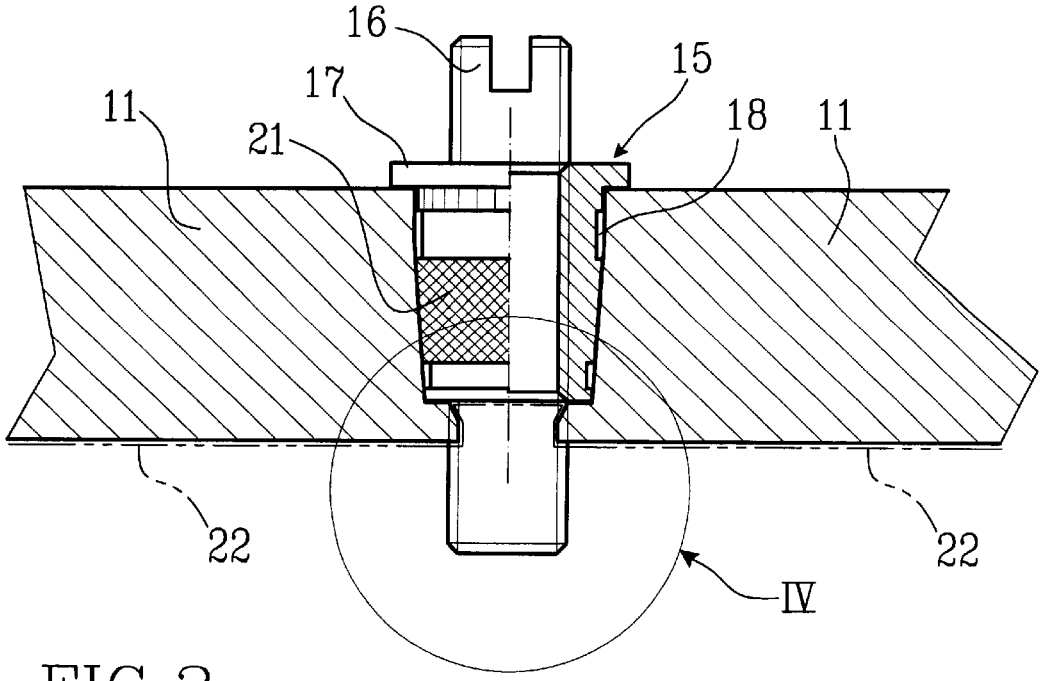
FIG. 2 is an enlargement of a part of the filter according to FIG. 1 with a partly cut-away bushing.
Figure 4:
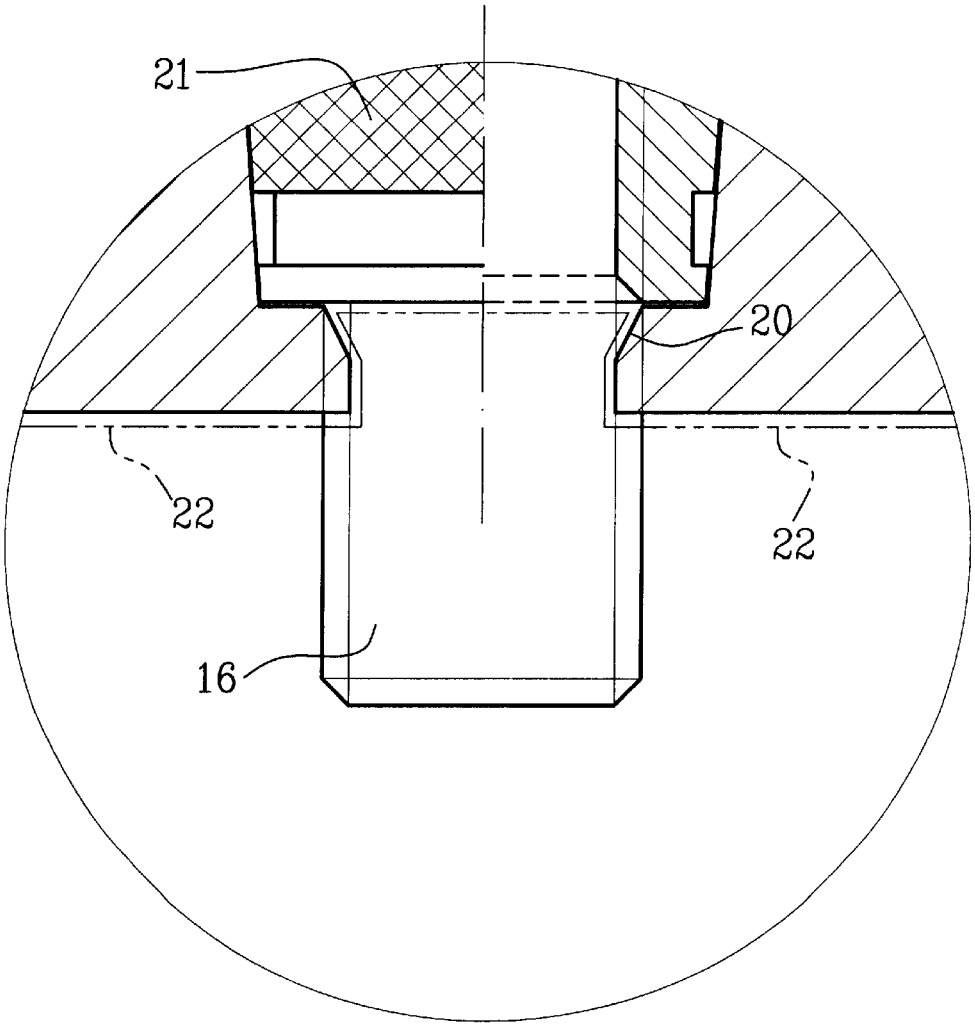
FIG. 4 is an enlarged view of the encircled part shown in FIG. 2.

If the compartment and cover of the filter are made of a non-conducting material which is coated, preferably both internally and externally or at least internally, with a conducting coating through metallisation, plating or the like. The conducting layer may comprise of any preferable conducting material, for example nickel, copper, gold, silver and so on, but in a preferred embodiment the nickel is first metallized onto the parts, and then are coated with copper. The conducting layer 22 is shown in FIG. 2 and 4 with dashed lines.

When manufacturing the filter, the cover and the compartment are produced, for example through moulding, casting, milling or the like. When moulding, the cover is moulded with one or several matched openings for thread bushings and each opening is provided with a beveled collar in the base or somewhere along the axial direction of the opening. The openings may obviously be produced through drilling or the like after the moulding. The diameter of the opening is adapted to the necessary screw and bushing length. The collar is fitted to the inside diameter of the screw. Afterwards, the thread bushings are pressed into the opening through forced fit, hot press or by heating the opening. The filter parts are metallized, which connects the filter cover with the bushing. When the screw is screwed through the bushing and out in the filter compartment, the metallized collar is pressed aside and through friction the screw is secured which simultaneously provides a good electric contact and tightness between it and the screw, and between the screw and the filter.

The added friction from the collar against the screw joint also results in elimination of the play which is found in a pitch of the threads. In this way, the screw is locked and the tuned value, i.e. the tuned frequency is not influenced.

Figure 5:
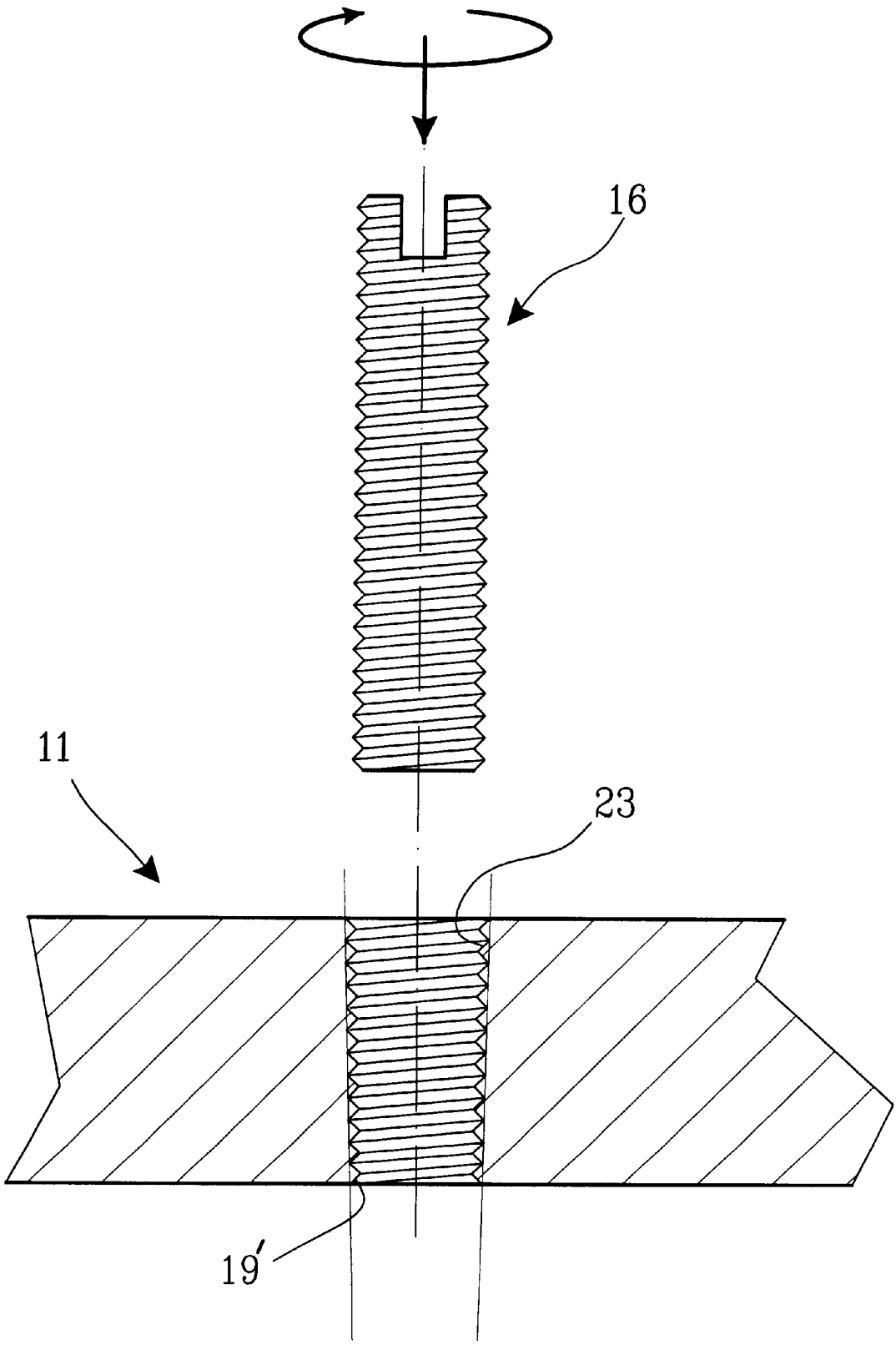
FIG. 5 is another embodiment of a screw threading and the screw, according to the invention.

In the embodiment according to FIG. 5, the conical threads 23 are mainly arranged directly in the opening 18. The conicity implies that the external diameter between the threads at insertion side is essentially larger than the external diameter of the exit side. The thread conicity may obviously occur only partly in the opening or through the entire opening, which is illustrated in the drawing. The essentially conical design means that, at least the threads 19' at exit side function as the collar, according to the preceding embodiment, and allows retention of the screw. Also, in this case the cover and the threads can be metallized. However, this embodiment is preferred in a cover made of metal.

In a further embodiment the bushing and the collar can be integrated (not shown) and inserted into the openings in the cover. Additionally, the trimming device can be arranged in the compartment and not in the cover as the embodiments have shown.

While we have illustrated and described preferred embodiments according to the invention, it is obvious that several variations and modifications within the scope of the attached claims may occur.

| DESIGNATION SIGNS | |
|---|---|
| 10 | Filter |
| 11 | Cover |
| 12 | Compartment |
| 13 | Resonator |
| 14 | Cavity |
| 15 | Trimming device |
| 16 | Screw |
| 17 | Bushing |
| 18 | Opening |
| 19, 19' | Collar |
| 20 | Bevel |
| 21 | Frictional area |
| 22 | Conducting coating |
| 23 | Threads |

What we claim is:

1. A trimming arrangement in a device for adjustment of electromagnetic waves, the arrangement including at least one trimming screw galvanically connected to the device and at least one bushing portion arranged for inserting and securing the trimming screw, wherein the bushing portion includes a substantially pervious opening arranged in a part of the device, a section arranged in the opening for reception of the screw and a constriction arranged in an axial direction of the opening, which constriction is provided to firmly but detachably secure the screw.

2. The arrangement of claim 1, wherein said adjustment is tuning.

3. The arrangement of claim 1, wherein said adjustment is frequency adaptation.

4. The arrangement of claim 1, wherein said bushing portion and a surface of the device are provided with and connected galvanically by a conducting coating.

5. The arrangement of claim 1, wherein said section includes a bushing.

6. The arrangement of claim 1, wherein said section is a threaded section arranged with substantially conical threads.

7. The arrangement of claim 1, wherein the constriction is provided with beveled edges for cooperation with the threads of the screw.

8. The arrangement of claim 1, wherein the galvanic connection between the screw and the device is obtained substantially through said constriction.

9. The arrangement of claim 2, wherein said conducting coating comprises one of nickel, copper, gold and silver.

10. A device for adjustment of electromagnetic waves, which device includes a compartment equipped with a number of resonators, a cover closing the compartment, one or more trimming arrangements provided in openings arranged for these and connection conductors, wherein each trimming arrangement includes a conducting trimming screw, a threaded part for reception of the screw and a constriction arranged in the axial direction of the opening formed as a collar with an internal diameter substantially corresponding to the inner diameter of the screw, the constriction provided to firmly but detachably secure the screw.

11. The device of claim 10, wherein the threaded part is a bushing inserted in each opening.

12. The device of claim 10, wherein the threaded part is substantially conical threads arranged in the opening.

13. The device of claim 10, wherein the constriction is a part of the opening.

14. The device of claim 10, wherein the device is a filter or resonator.

15. The device of claim 10, wherein said electromagnetic waves are microwaves.

16. The device of claim 10, wherein it is made of an insulating material and coated with a conducting coating.

17. The device of claim 16, wherein the insulating material is a polymer material with a metallized surface, which allows a cold flow in the material.

18. The device of claim 10, wherein the device is made of a conducting or partly conducting material.

19. The device of claim 10, wherein said adjustment is tuning.

20. The device of claim 10, wherein said adjustment is frequency adaptation.

21. A method for producing a bushing portion in a device for adjustment of electromagnetic waves, which device includes a compartment equipped with a number of resonators, a cover closing the compartment, one or more trimming arrangements provided in substantially pervious openings arranged for these and connection conductors, wherein each trimming arrangement includes a conducting trimming screw, a threaded part for reception of the screw and a constriction arranged in the axial direction of the opening formed as a collar with an internal diameter substantially corresponding to the inner diameter of the screw, the constriction provided to firmly but detachably secure the screw, the method comprising the steps of:

producing at least some portion of the device, arranging at least the pervious opening with a cross-sectionally varying diameter, inserting the bushing portion in the opening, and providing the bushing portion and parts of the device with a conduction coating.

22. The method of claim 21, wherein said some portion is made through one of moulding, casting and milling.

23. The method of claim 21, wherein the bushing is inserted into the opening through at least one of press fitting and hot pressing.

24. The arrangement of claim 6, wherein a portion of the threaded section having a diameter substantially corresponding to the inner diameter of the screw operates as the constriction.

25. The device of claim 12, wherein a portion of the threaded part having a diameter substantially corresponding to the inner diameter of the screw operates as the constriction.

* * * * *